US005792950A

United States Patent [19]

Shonting

[11] Patent Number: 5,792,950

[45] Date of Patent: Aug. 11, 1998

[54] SUBMARINE DEPLOYED SEA-STATE SENSOR

[75] Inventor: David H. Shonting, Middletown, R.I.

[73] Assignee: The United States of America as represented by the Secretary of the Navy, Washington, D.C.

[21] Appl. No.: 591,183

[22] Filed: Jan. 16, 1996

[51] Int. Cl.[6] ..... G01W 1/00

[52] U.S. Cl. ..... 73/70.34; 73/170.29; 367/134

[58] Field of Search ..... 73/170.29, 170.31, 73/170.33, 170.34

[56] References Cited

U.S. PATENT DOCUMENTS

| | | | |
|---|---|---|---|
| 3,225,593 | 12/1965 | Richard | 73/170.31 |
| 3,349,613 | 10/1967 | Francis | 73/170.34 |
| 4,220,044 | 9/1980 | LeBlanc et al. | 73/170.31 |
| 4,794,575 | 12/1988 | Miller | 73/170.34 |
| 5,046,359 | 9/1991 | Layport | 73/170.33 |
| 5,283,767 | 2/1994 | McCoy | 73/170.34 |

*Primary Examiner*—Richard Chilcot
*Assistant Examiner*—Ronald Biegel
*Attorney, Agent, or Firm*—Michael J. McGowan; Michael F. Oglo; Prithvi C. Lall

[57] ABSTRACT

A submarine deployed sea-state sensor comprises an elongated housing having a nose cone and an aft end, the housing having a forward buoyant chamber for receiving an accelerometer. Aft of the buoyant chamber, a damping assembly communication link deployment means and a lifting body are provided. Both the damping assembly and the lifting body are attached to a communication link interconnecting the accelerometer and a submerged platform so that, when the portion of the communication link between the lifting body and the submerged platform becomes taught, the lifting body is pulled from the housing. The damping assembly includes a motion damping body mounted on the buoyant chamber through an extendable telescoping arm. The extension of the arm is controlled by a pressure release spring, so that, when the sensor reaches a selected depth the telescoping arm will extend to project the motion damping body aftwardly.

6 Claims, 3 Drawing Sheets

SUBMARINE DEPLOYED SEA-STATE SENSOR

STATEMENT OF GOVERNMENT INTEREST

The invention described herein may be manufactured by or for the Government of the United States of America for Governmental purposes without the payment of any royalties thereon or therefor.

BACKGROUND OF THE INVENTION (1) Field of the Invention

The invention relates generally to the field of electronic sensing devices, and more particularly to sensors for sensing selected conditions on an ocean surface. The invention specifically provides a sensor which may be deployed by a submarine or other submerged platform, which can obtain wave statistics regarding significant wave height, mean and "rms" (root-mean-square) wave height, wave frequency spectra information, variance, the significance and mean period and sea state, from which conditions such as surface wind speed can be determined.

(2) Description of the Prior Art

It is often necessary for a platform such as a submarine submerged in, for example, an ocean environment, to determine wave conditions at the surface. Wave conditions can, for example, adversely effect launch of a missile. High-energy wave conditions can produce dynamic motions and pressure fluctuations which can perturb or damage slowly ascending missiles. Large waves can cause rolling motions which are transferred to the submarine, which can prevent safe launching of any missile system. In addition, whitecap turbulence of breaking waves can scatter and absorb sound energy generated by sonar devices and the like.

U.S. Pat. No. 4,794,575 describes a submarine-launched sea state buoy which can be deployed by a submerged platform for use in sensing surface conditions, such as wave amplitude and frequency. The buoy described in that patent includes a multi-chambered, buoyant cylindrical housing which houses an accelerometer and other electronic equipment. The buoy floats on the ocean surface and the accelerometer senses vertical acceleration of the buoy by the surface wave motion. The buoy includes a counterweight that operates to maintain the buoy in a predetermined orientation on the surface. A wire data link links the accelerometer and electronic equipment on the buoy to the submerged platform to provide data generated by the accelerometer and electronic equipment to the submerged platform. A time after deployment, the buoy will be scuttled by flooding by the dissolving of a sodium chloride plug.

There are a number of problems with the buoy as described in the '575 patent. For example, when the buoy is fully deployed, the data link, which is formed from a filament wire, can abrade on the edge of the buoy housing, which can interrupt data transmission. In addition, the buoy's motion damping means does not provide sufficient extension of mass of the body to sufficiently reduce pitch and roll imposed by the high frequency breaking wave turbulence. The dynamics of the buoy with respect to its heave and tilt charateristics were not investigated either theoretically or experimentally, and hence it proved to not be well adapted to real ocean conditions.

SUMMARY OF THE INVENTION

It is therefore an object of the invention to provide a new and improved submarine-deployed sea state sensor.

In brief summary, a submarine deployed sea-state sensor comprises an elongated housing having a nose cone and an aft end, the housing having a forward buoyant chamber for receiving an accelerometer. Aft of the buoyant chamber, a damping assembly communication link deployment means and a lifting body are provided. Both the damping assembly and the lifting body are attached to a communication link interconnecting the accelerometer and a submerged platform so that, when the portion of the communication link between the lifting body and the submerged platform becomes taught, the lifting body is pulled from the housing. The damping assembly includes a motion damping body mounted on the buoyant chamber through an extendable telescoping arm. The extension of the arm is controlled by a pressure release spring, so that, when the sensor reaches a selected depth the telescoping arm will extend to project the motion damping body aftwardly.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DESCRIPTION OF THE PREFERRED EMBODIMENT

Figure 1:
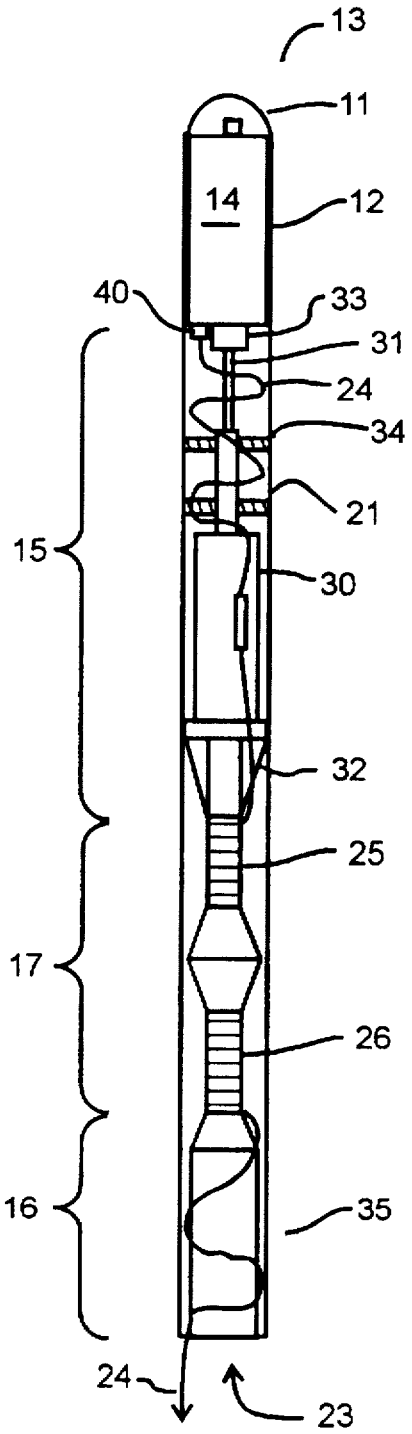
FIG. 1 is a diagram, in schematic form, of a submarine deployed sea state sensor constructed in accordance with the invention.

FIG. 1 is a diagram, in schematic form, of a submarine deployed sea state sensor 10 constructed in accordance with the invention. With reference to FIG. 1, sensor 10 is effectively in the form of a spar buoy comprising a cylindrical housing 11 including a cylindrical sidewall 12 with a removable hemispherical nose cone 13. The housing 11 houses a sealed electronics package 14 that includes conventional accelerometer and preliminary processing circuitry (not separately shown) that can detect acceleration as applied to the accelerometer and generate an output signal representative thereof for transmission to a deploying platform such as a submarine. The housing 11 also houses three other subsystems, namely, a telescoping vane/damping assembly 15 and a lifting body assembly 16, and a communication link dispensing assembly 17, all of which will be described in detail below.

Generally, electronics package 14 is mounted in a sealed waterproof chamber 20 formed by the removable nose cone 13, a bulkhead 21 and a portion of the sidewall 12 between the nose cone 13 and the bulkhead. The nose cone 13 is removable so that, prior to deployment of the sensor 10, an operator can remove the nose cone, and activate the electronics package 14 by means of, for example, a switch 22. After activation, the operator can restore the nose cone to re-seal the chamber 20. In one embodiment, the nosecone 13 is threadably mounted on the sidewall 12 to form the chamber 20.

The portion of the sensor 10 below the bulkhead 21 is open, although during storage prior to employment a removable cap (not shown) may be used to cover the aft end 23 of the housing 11.

As noted above, the housing 11 houses, in addition to the electronics package 14, three other subsystems, namely, a telescoping vane/damping assembly 15, a lifting body assembly 16, and a communication link dispensing assembly 17. The telescoping vane/damping assembly 15, after deployment, will help dampen pitch and roll of the sensor 10, that is, deviations of the sensor 10 from the vertical, and in addition can dampen motion due to high-frequency wave motion, so that the sensor 10 will primarily sense low-frequency motion reflecting to conditions that can affect missile launch.

The vane/damping assembly includes a cylindrical tube 30 mounted at the lower end of a telescoping tube 31. At the lower end of the tube 30 is a vane assembly 32. The telescoping tube 31 is mounted on a pressure spring 33, which, when it detects a selected pressure level representative of the sensor 10 approaching the surface after deployment, extends the telescoping tube 31 to project the tube 30 and vane assembly 32 downwardly and out of the aft end 23 of the sensor 10. The bulkhead 21, and a second bulkhead 34, hold the telescoping tube 31 in axial alignment. A portion of the communication link dispensing assembly 17, namely, a spool 25, is mounted on the lower end of the vane/damping assembly 15.

The lifting body assembly 16 assists in deployment of a communication link 24 which connects the electronics package 14 to the deploying submarine (not shown). The lifting body 16 includes a cylindrical body 35. A second portion of the communication link dispensing assembly, namely, a spool 26, is mounted on the upper end of the cylindrical body 35. The communication link 24 is connected to a connector 40 on the lower end of the electronics package 14, is affixed to the tube 30 of the vane/damping assembly 15, is wound around the spools 25 and 26, and also around the cylindrical body 35.

The communication link 24 may be any convenient signal-carrying link, including electrical wires, optical fibers or the like.

Deployment of the sensor 10 will be described in connection with FIG. 1 and also FIG. 2, which depicts the sensor 10 in a deployed condition. With reference to those FIGS., immediately prior to deployment, the operator will remove the nosecone 13, use the switch 22 to activate the electronics package 14 by means of the switch 22 and replace the nosecone 13 to seal the chamber 20. In addition, if the aft end 23 is covered by a cap for storage, the operator will remove the cap. Thereafter, the operator will eject the sensor 10 through a conventional aperture in the outer wall of the submarine into the ocean environment.

After ejection, the buoyancy provided by the sealed chamber 20 will cause the sensor 10 to rise toward the ocean surface. After the portion of the communication link 24 between the lifting body assembly 16 and the submarine becomes taught, the communication link 24 will pull the lifting body assembly out of the aft end 23 of the housing 11. Thereafter, the communication link 24 will deploy from both the spool 26 attached to the lifting body assembly and the spool 25 attached to the vane/damping assembly 15.

When the sensor 10 has risen to a selected distance (such as a few meters) below the ocean surface, the pressure release spring 33 will cause the telescoping tube to deploy, extending the vane/damping assembly 15 downwardly out the aft end 23 of the housing 11. It will be appreciated that, since the communication link 24 is attached at the connector 40, on the vane/damping assembly 15, and on the lifting body assembly 16, it will not come into contact with the edge of the sidewall at the aft end of the housing 11, and therefore will not abrade thereon.

After the sensor 10 reaches the ocean surface, the sensor can begin generating vertical acceleration data caused by wave motion on the buoyant chamber 20, for transmission over the communication link 24 to the submarine. It will be appreciated that the vane/damping assembly 15 will prevent the sensor from pitching, maintaining the sensor 10 in a vertical position, and will also dampen high-frequency acceleration components. At the time of surfacing, a passive scuttling device (not shown) will activate, having been whetted by the seawater. The scuttling device may be either a polyvinyl alcohol membrane or a calcium carbide plug which may be mounted proximate the nose cone 11.

Figure 2:
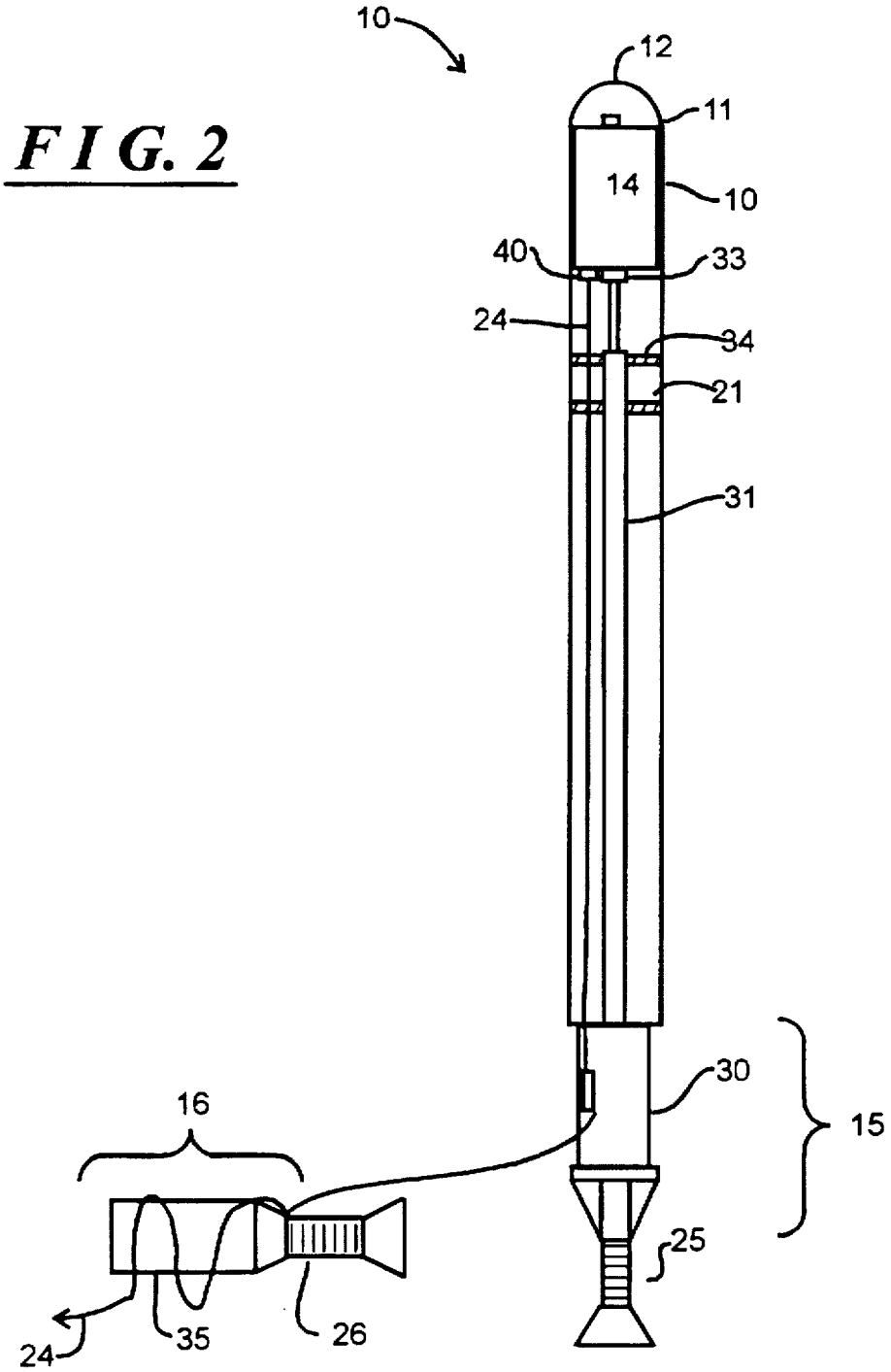
FIG. 2 is a diagram, in like schematic form, of the sea state sensor depicted in FIG. 1, in a deployed condition.
Figure 3:
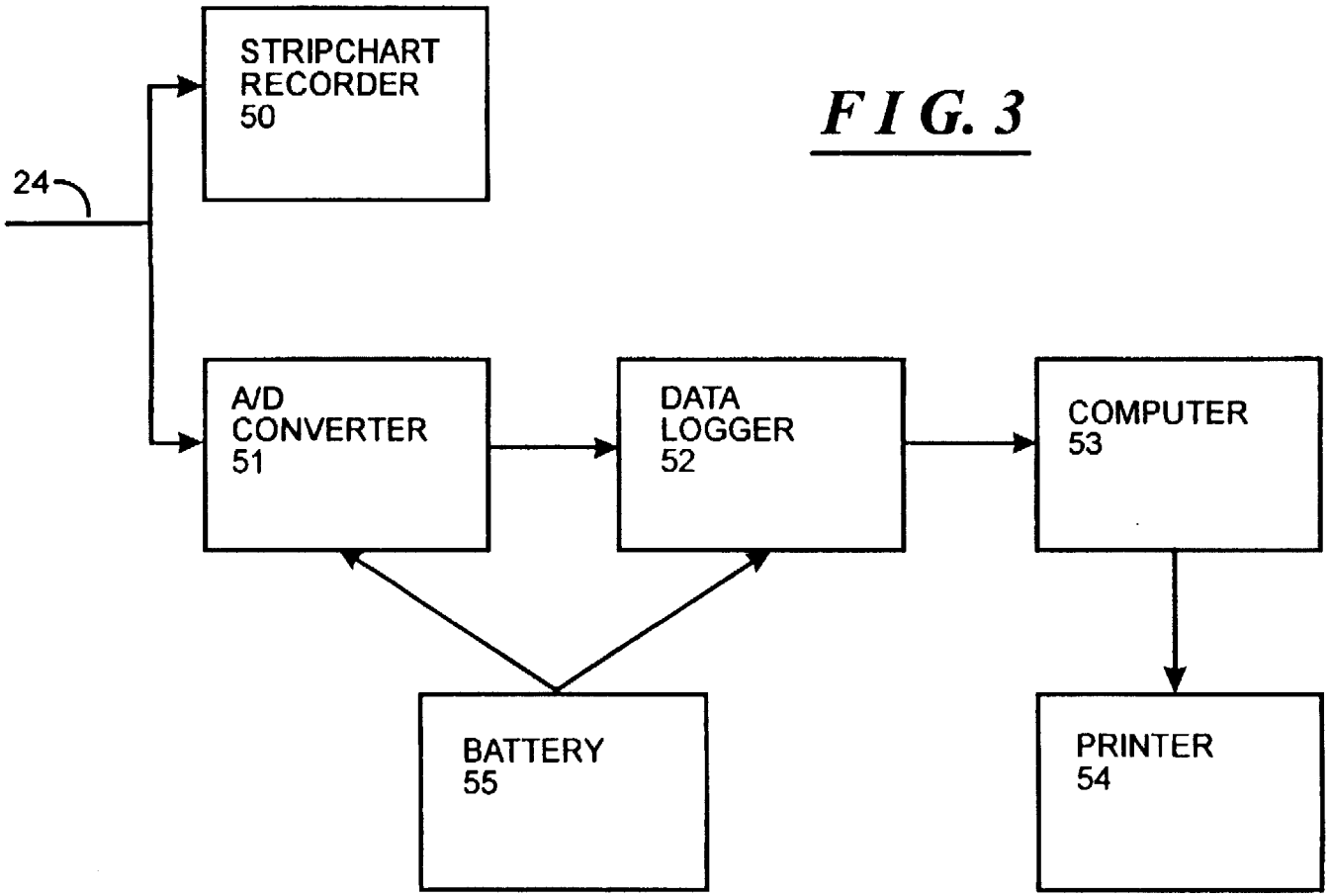
FIG. 3 is a functional block diagram depicting apparatus for processing signals received from the sea state sensor depicted in FIGS. 1 and 2.

FIG. 3 depicts a functional block diagram depicting apparatus which may be used to process signals received from the sea state sensor depicted in FIGS. 1 and 2. With reference to FIG. 3, the communication link 24 is connected to a strip chart recorder 50, which can generate an analog recording of the signal received from the sensor as a function of time, and an analog to digital converter 51 which generates a digital data sequence representing the amplitude of the signal from the sensor at sequential points in time. A data logger 52 records the digital data for processing by a computer 53. A printer 54 may provide a hardcopy output from the computer. The analog to digital converter 51 and data logger 52 may be provided in the electronics package 14 on the sensor 10, and if so a battery 55 may be provided to power these elements.

As noted above, the computer 55 processes the digital data received from the sensor 10. It will be appreciated that, since the data received from the sensor 10 is acceleration data, and since acceleration is the second derivative of distance with respect to time, the ocean surface elevation information, or heave n(t) is obtained by integrating the acceleration data $a_z(t)$ twice with respect to time $$n(t)=\int a_z(t)dt\,dt \tag{1}$$

The frequency spectrum, which provides the distribution of energy content $\zeta(t)$ as a function of frequency $F(\omega)$, is generated in a conventional manner using the FFT taken over a sampling period T as $$F(\omega)=\frac{1}{T}\int_{-T/2}^{T/2} n(t)\,e^{-i\omega t}dt;\ n=0,\pm1,\pm2,\ldots \tag{2}$$

The energy spectrum, defined as $$|F_m(\omega)|^2=\Phi_m(\omega) \tag{3}$$

is the contribution to the variance as a function of frequency. Since the acceleration applied by the wave motion is sinusoidal in nature, the integration in equation (1) will vary as $(1/\omega)^2$. The computer 53 applies corrections for estimates at low-frequencies, with the corrected estimate of the wave spectrum $\Phi(\omega)$ being related to the raw spectrum $\Phi_m(\omega)$ in equation (3) by $$\Phi(\omega)=\frac{\Phi_m(\omega)}{R(\omega)\,H(\omega)} \tag{4}$$

where $R(\omega)$ is a frequency-dependent function related to sensor and electronics characteristics, and $H(\omega)$ is a frequency-dependent response function of the sensor 10 in the waves. These functions reflect non-linear sensor and wave effects at low and high frequencies.

The invention provides a number of advantages. In particular, the vane/damping assembly 15 and lifting body assembly 16 cooperate to ensure that the communication link 24 does not abrade on the housing 11 when the sensor 10 is deployed. In addition, the vane/damping assembly 15 ensures that the sensor will maintain a vertical position, and acts to filter high-frequency accelerations which the sensor 10 is to ignore.

The preceding description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. A submarine deployed sea-state sensor comprising:

an elongated housing having a nose cone and an aft end, the housing having a forward buoyant chamber for receiving an accelerometer;

the housing further having, aft of the buoyant chamber, a damping assembly affixed to the buoyant chamber, communication link deployment means and a lifting body, with both the damping assembly and the lifting body being attached to a communication link interconnecting the accelerometer and a submerged platform so that, when the portion of the communication link between the lifting body and the submerged platform becomes taut, the lifting body is pulled from the housing; and the damping assembly includes a motion damping body mounted on the buoyant chamber through an extendable telescoping arm, the extension of the arm being controlled by a pressure release spring, so that, when the sensor reaches a selected depth the telescoping arm will extend to project the motion damping body aftwardly.

2. A submarine deployed sea-state sensor as defined in claim 1 in which the housing includes a plurality of bulkheads, the arm extending through the bulkheads, the bulkheads maintaining the arm along an axial direction.

3. A submarine deployed sea-state sensor as defined in claim 1 in which the housing further includes spool means for holding the communication link during deployment.

4. A submarine deployed sea-state sensor as defined in claim 1 in which the housing further includes a scuttling means.

5. A submarine deployed sea-state sensor as defined in claim 4 in which the scuttling means comprises a polyvinyl alcohol membrane proximate the nose cone.

6. A submarine deployed sea-state sensor as defined in claim 4 in which the scuttling means comprises a calcium carbide plug proximate the nose cone.

* * * * *